US010673142B2

(12) United States Patent
Ueda

(10) Patent No.: US 10,673,142 B2
(45) **Date of Patent: *Jun. 2, 2020**

(54) ANTENNA MODULE

(71) Applicant: Murata Manufacturing Co., Ltd., Kyoto (JP)

(72) Inventor: Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/386,491

(22) Filed: Apr. 17, 2019

(65) Prior Publication Data

US 2019/0252784 A1 Aug. 15, 2019

Related U.S. Application Data

(63) Continuation of application No. 15/685,010, filed on Aug. 24, 2017, now Pat. No. 10,305,189.

(30) Foreign Application Priority Data

Aug. 26, 2016 (JP) ..... 2016-165647

(51) Int. Cl.
*H01Q 1/28* (2006.01)
*H01Q 9/04* (2006.01)
(Continued)

(52) U.S. Cl.
CPC ..... *H01Q 9/0414* (2013.01); *H01Q 1/2283* (2013.01); *H01Q 1/243* (2013.01);
(Continued)

(58) Field of Classification Search
CPC ..... H01Q 1/38; H01Q 9/04; H01Q 1/22
(Continued)

(56) References Cited

U.S. PATENT DOCUMENTS 6,518,932 B1 2/2003 Matsui
7,239,851 B2 7/2007 Kosemura
(Continued)

FOREIGN PATENT DOCUMENTS

CN 101625730 A 1/2010
JP 2005-340790 A 12/2005
(Continued)

*Primary Examiner* — Peguy Jean Pierre
(74) *Attorney, Agent, or Firm* — Pearne & Gordon LLP

(57) ABSTRACT

A circuit element mounting portion provided on a dielectric substrate is configured so as to mount a high-frequency integrated circuit element, and includes a ground land and a plurality of high-frequency signal lands. The dielectric substrate is provided with an antenna element including at least one radiation element. The dielectric substrate is provided with an exposed terminal portion including an exposed ground land and an exposed high-frequency signal land. The dielectric substrate is provided with a first transmission line connecting one high-frequency signal land of the circuit element mounting portion and the radiation element. Furthermore, a second transmission line connecting another high-frequency signal land of the circuit element mounting portion and the high-frequency signal land of the exposed terminal portion, and a ground conductor connecting the ground land of the circuit element mounting portion and the ground land of the exposed terminal portion are provided.

14 Claims, 10 Drawing Sheets

(51) Int. Cl.

| | |
|---|---|
| ***H01Q 1/22*** | (2006.01) |
| ***H01Q 1/24*** | (2006.01) |
| ***H01Q 9/32*** | (2006.01) |
| ***H01Q 21/06*** | (2006.01) |
| ***H01Q 21/28*** | (2006.01) |
| ***H01Q 21/29*** | (2006.01) |
| *H01Q 21/00* | (2006.01) |

(52) U.S. Cl.
CPC ..... *H01Q 9/0407* (2013.01); *H01Q 9/32* (2013.01); *H01Q 21/06* (2013.01); *H01Q 21/28* (2013.01); *H01Q 21/29* (2013.01); *H01Q 9/0471* (2013.01); *H01Q 21/0093* (2013.01)

(58) Field of Classification Search
USPC ..... 343/850
See application file for complete search history.

(56) References Cited

U.S. PATENT DOCUMENTS

| | | | | |
|---|---|---|---|---|
| 8,456,377 | B2 * | 6/2013 | Kyeong ..... | H01Q 21/28 343/879 |
| 2005/0285234 | A1 | 12/2005 | Kanno | |
| 2006/0017157 | A1 | 1/2006 | Yamamoto et al. | |
| 2010/0001906 | A1 | 1/2010 | Akkermans | |
| 2015/0318614 | A1 | 11/2015 | Kato et al. | |

FOREIGN PATENT DOCUMENTS

| | | | |
|---|---|---|---|
| JP | 2006-186436 | A | 7/2006 |
| JP | 2009-081833 | A | 4/2009 |
| JP | 2010-016789 | A | 1/2010 |
| WO | 00/48269 | A1 | 8/2000 |

* cited by examiner

ANTENNA MODULE

This is a continuation of U.S. patent application Ser. No. 15/685,010 filed on Aug. 24, 2017 which claims priority from Japanese Patent Application No. 2016-165647 filed on Aug. 26, 2016. The content of each of these applications is incorporated herein by reference in its entirety.

The present disclosure relates to an antenna module. A wireless communication device including an antenna integrated type module is known (Japanese Unexamined Patent Application Publication No. 2009-81833). This wireless communication device includes a mounting substrate having a substantially rectangular through-hole and the antenna integrated type module mounted on the mounting substrate so as to cover the through-hole. A patch antenna is provided on a surface, which is exposed to the through-hole, of the antenna integrated type module. Radio waves radiated from the patch antenna propagate in the through-hole, and are radiated in a front direction as they are.

Normally, in front of a patch antenna, an opening portion in which a metal member which serves as a radio wave shielding object is not disposed is necessary. In a small mobile terminal such as a smartphone or the like, a position where an opening portion can be provided in a housing is limited. Due to a large display being disposed on a front surface of the housing, a position of the opening portion provided on the front surface is largely restricted in particular. The position of the opening portion is restricted, and thus an installation place of an antenna module including the patch antenna or the like is also limited.

When an installation place is limited for each mobile terminal model, it is necessary to design an antenna module having a shape and directional characteristics suitable for the installation place for each mobile terminal model. Even in the case where a requirement specification for the antenna module is different for each mobile terminal model, an easily customizable antenna module in accordance with requirement specifications for various models is desired.

BRIEF SUMMARY

The present disclosure provides an easily customizable antenna module in accordance with requirement specifications for various models.

An antenna module according to a first aspect of the present disclosure includes:

a dielectric substrate;

a circuit element mounting portion provided on the dielectric substrate, configured so as to mount a high-frequency integrated circuit element, and including a ground land and a plurality of high-frequency signal lands;

an antenna element including at least one radiation element provided on the dielectric substrate;

an exposed terminal portion provided on the dielectric substrate, and including an exposed ground land and an exposed high-frequency signal land;

a first transmission line provided in the dielectric substrate, and connecting one high-frequency signal land of the circuit element mounting portion and the radiation element;

a second transmission line provided in the dielectric substrate, and connecting another high-frequency signal land of the circuit element mounting portion and the high-frequency signal land of the exposed terminal portion; and a ground conductor connecting the ground land of the circuit element mounting portion and the ground land of the exposed terminal portion.

An antenna element customized in accordance with a requirement specification can be mounted on the exposed terminal portion. Mounting a common antenna module for mobile terminals or the like of different models and mounting an antenna element customized for each model on the exposed terminal portion of the antenna module make it possible to flexibly cope with a requirement specification for each model.

In an antenna module according to a second aspect of the present disclosure, in addition to the configuration of the antenna module according to the first aspect, the antenna element includes the radiation element provided on a surface on an opposite side from a surface of the dielectric substrate on which the circuit element mounting portion is provided, and the exposed terminal portion is provided on a surface same as the surface of the dielectric substrate on which the circuit element mounting portion is provided.

The antenna element provided on the dielectric substrate makes it possible to radiate radio waves in a direction to which the surface on the opposite side from the surface on which the circuit element mounting portion is provided faces, and the antenna element mounted on the exposed terminal portion makes it possible to radiate radio waves in a direction to which the surface on which the circuit element mounting portion is provided faces.

In an antenna module according to a third aspect of the present disclosure, in addition to the configuration of the antenna module according to the first aspect, the dielectric substrate is configured of a flexible printed circuit substrate, the antenna element is provided on the surface on the opposite side from the surface of the dielectric substrate on which the circuit element mounting portion is provided, and includes the radiation element disposed at a position at least partially overlapping with the circuit element mounting portion, and the exposed terminal portion is disposed at a position not overlapping with both the circuit element mounting portion and the radiation element.

Deforming the flexible printed circuit substrate makes it possible to change a positional relationship between the antenna element provided on the dielectric substrate and the antenna element mounted on the exposed terminal portion. This makes it possible to enhance the degree of freedom of an arrangement position of the antenna element.

In an antenna module according to a fourth aspect of the present disclosure, in addition to the configurations of the antenna modules according to the first to third aspects, the circuit element mounting portion further includes an intermediate-frequency signal land and a DC power supply land, the exposed terminal portion further includes an exposed intermediate-frequency signal land and an exposed DC power supply land, the antenna module further includes:

an intermediate-frequency signal fourth transmission line provided in the dielectric substrate, and connecting the intermediate-frequency signal land of the circuit element mounting portion and the intermediate-frequency signal land of the exposed terminal portion; and a power supply wiring provided in the dielectric substrate, and connecting the DC power supply land of the circuit element mounting portion and the DC power supply land of the exposed terminal portion.

A baseband integrated circuit element can be connected to the antenna module through the DC power supply land and the intermediate-frequency signal land of the exposed terminal portion.

An antenna element customized in accordance with a requirement specification can be mounted on the exposed terminal portion. Mounting a common antenna module for mobile terminals or the like of different models and mounting an antenna element customized for each model on the exposed terminal portion of the antenna module make it possible to flexibly cope with a requirement specification for each model.

Other features, elements, and characteristics of the present disclosure will become more apparent from the following detailed description of embodiments of the present disclosure with reference to the attached drawings.

DETAILED DESCRIPTION

First Embodiment

An antenna module according to a first embodiment will be described with reference to FIG. 1A to FIG. 4.

Figure 1A:
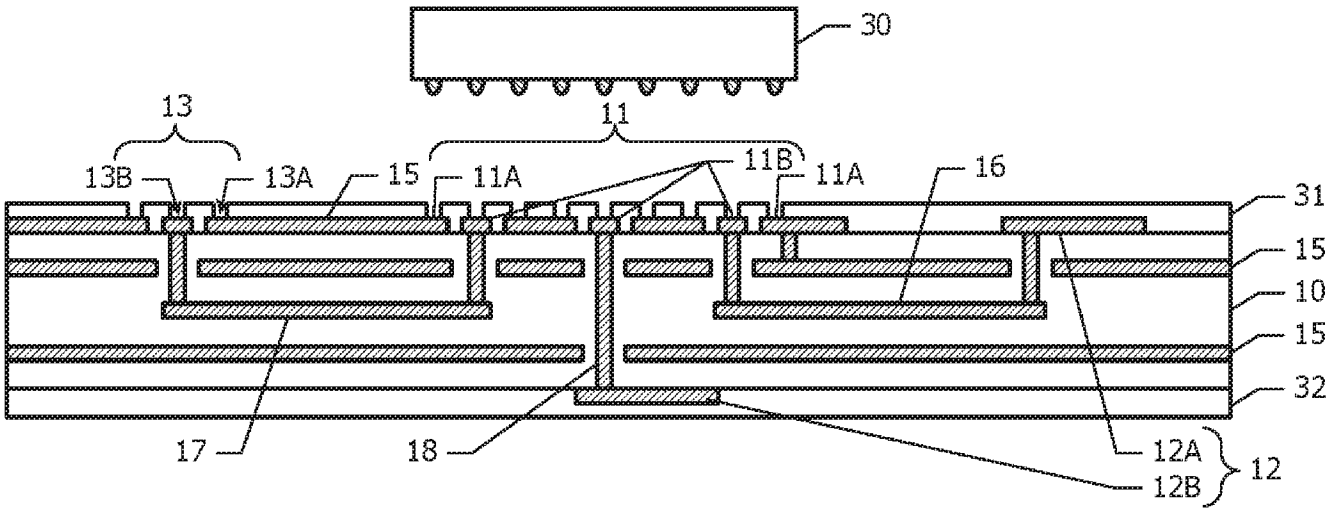
FIG. 1A is a cross-sectional view of an antenna module according to a first embodiment.

FIG. 1A is a cross-sectional view of the antenna module according to the first embodiment. A dielectric substrate 10 is provided with a circuit element mounting portion 11, an antenna element 12, and an exposed terminal portion 13. The antenna element 12 includes a radiation element 12A provided on one surface (upper surface) of the dielectric substrate 10 and a radiation element 12B provided on the other surface (lower surface). The radiation element 12A is covered by a solder resist film 31 formed on the upper surface of the dielectric substrate 10, the radiation element 12B is covered by a solder resist film 32 formed on the lower surface of the dielectric substrate 10.

The circuit element mounting portion 11 includes a plurality of ground lands 11A and a plurality of high-frequency signal lands 11B provided on the upper surface of the dielectric substrate 10. Terminals of a high-frequency integrated circuit element 30 are connected to these lands 11A and 11B. For example, the plurality of ground lands 11A and ground terminals of the high-frequency integrated circuit element 30 are connected, and the plurality of high-frequency signal lands 11B and corresponding high-frequency signal terminals of the high-frequency integrated circuit element 30 are connected. In this manner, the circuit element mounting portion 11 is configured such that the high-frequency integrated circuit element 30 is mounted.

The exposed terminal portion 13 includes at least one ground land 13A and at least one high-frequency signal land 13B provided on the upper surface of the dielectric substrate 10. A part of an upper surface of each of the lands 13A and 13B of the exposed terminal portion 13 is exposed in an opening provided in the solder resist film 31.

Ground conductors 15 are disposed on the upper surface and in the inside of the dielectric substrate 10. Furthermore, a first transmission line 16, a second transmission line 17, and a third transmission line 18 are provided in the dielectric substrate 10. The first transmission line 16 connects one high-frequency signal land 11B of the circuit element mounting portion 11 and the radiation element 12A. The second transmission line 17 connects another high-frequency signal land 11B of the circuit element mounting portion 11 and the high-frequency signal land 13B of the exposed terminal portion 13. The third transmission line 18 connects still another high-frequency signal land 11B of the circuit element mounting portion 11 and the radiation element 12B. The ground conductor 15 connects the ground land 11A of the circuit element mounting portion 11 and the ground land 13A of the exposed terminal portion 13.

Each of the radiation elements 12A and 12B configures a patch antenna with the ground conductor 15 in an inner layer. The radiation element 12A radiates radio waves to the upper surface side of the dielectric substrate 10, the radiation element 12B radiates radio waves to the lower surface side of the dielectric substrate 10.

Figure 1B:
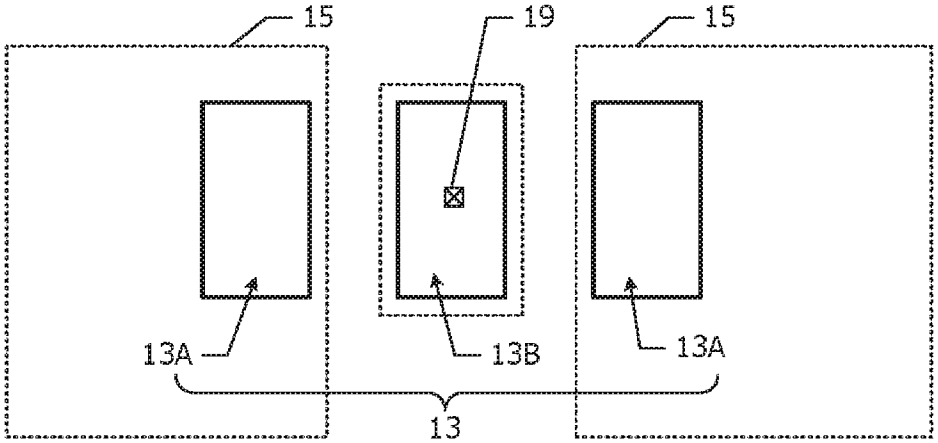
FIG. 1B is a plan view of an exposed terminal portion.

FIG. 1B is a plan view of the exposed terminal portion 13. The high-frequency signal land 13B is disposed between a pair of ground lands 13A. Each ground land 13A is continued to the ground conductor 15 disposed on the upper surface or in the inner layer of the dielectric substrate 10. The high-frequency signal land 13B is connected to the second transmission line 17 (FIG. 1A) in the inner layer through a conductor via 19.

When the high-frequency integrated circuit element 30 is mounted on the circuit element mounting portion 11, from the high-frequency integrated circuit element 30, high-frequency power is supplied to the radiation element 12A through the first transmission line 16, high-frequency power is supplied to the high-frequency signal land 13B of the exposed terminal portion 13 through the second transmission line 17, and high-frequency power is supplied to the radiation element 12B through the third transmission line 18.

Next, a first utilization form of the antenna module according to the first embodiment will be described with reference to FIG. 2A and FIG. 2B.

Figure 2A:
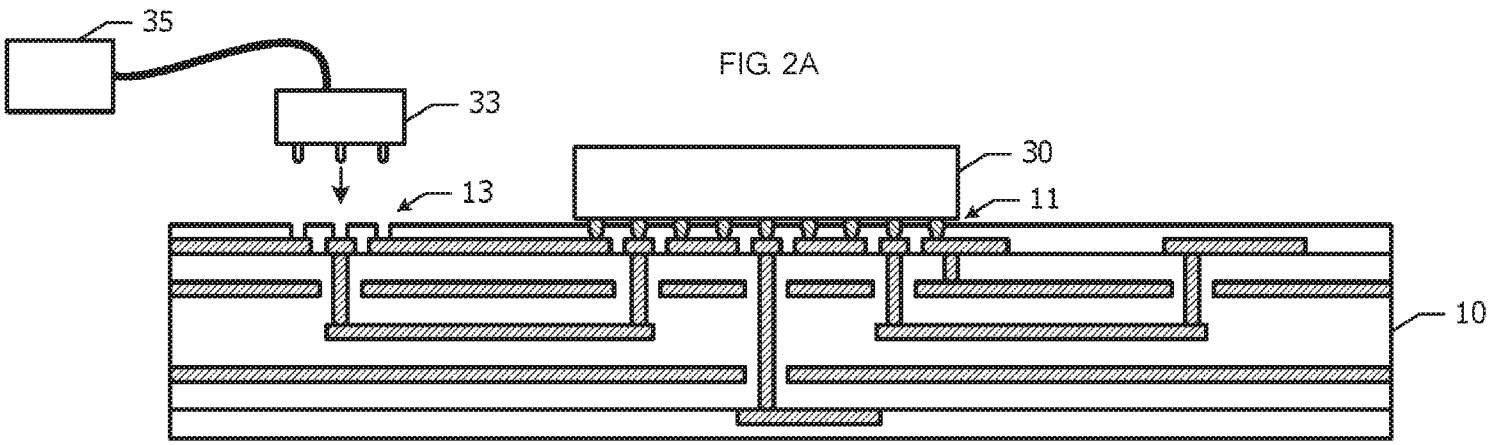
FIG. 2A is a cross-sectional view of the antenna module according to the first embodiment in a state of being used in a first utilization form.

FIG. 2A is a cross-sectional view of the antenna module according to the first embodiment in a state of being used in the first utilization form. The high-frequency integrated circuit element 30 is mounted on the circuit element mounting portion 11. A high-frequency probe 33 of a high-frequency inspection device 35 is brought into contact with the exposed terminal portion 13.

Figure 2B:
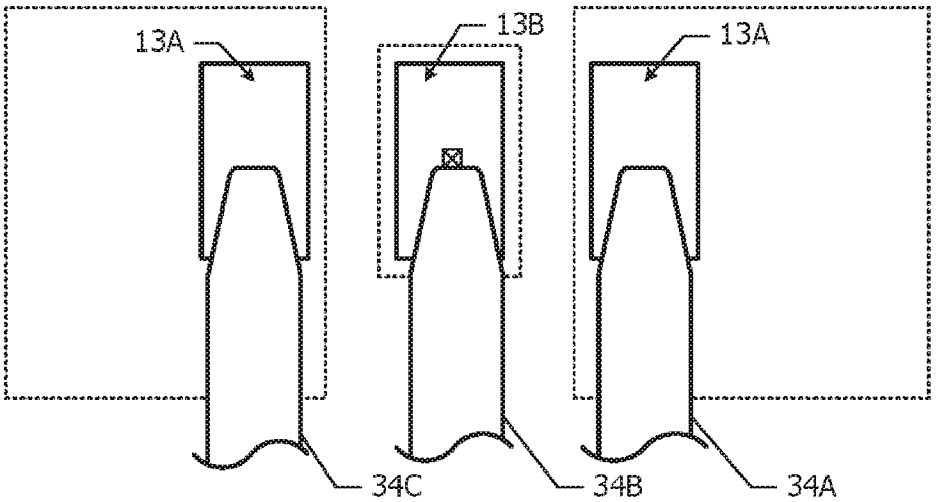
FIG. 2B is a plan view of the exposed terminal portion of the antenna module according to the first embodiment in the state of being used in the first utilization form.

FIG. 2B is a plan view of the exposed terminal portion 13 of the antenna module according to the first embodiment in the state of being used in the first utilization form. Probe needles 34A, 34B, and 34C of the high-frequency probe 33 (FIG. 2A) are brought into contact with one ground land 13A, the high-frequency signal land 13B, and the other ground land 13A, respectively.

The high-frequency probe 33 being brought into contact with the exposed terminal portion 13 makes it possible to perform wired inspection of the high-frequency integrated circuit element 30. The wired inspection makes it possible to inspect more easily and accurately than inspection in which radio waves radiated from the radiation elements 12A and 12B are measured. In this manner, in the first utilization form, the exposed terminal portion 13 is used as a terminal for inspection.

Next, a second utilization form of the antenna module according to the first embodiment will be described with reference to FIG. 3.

Figure 3:
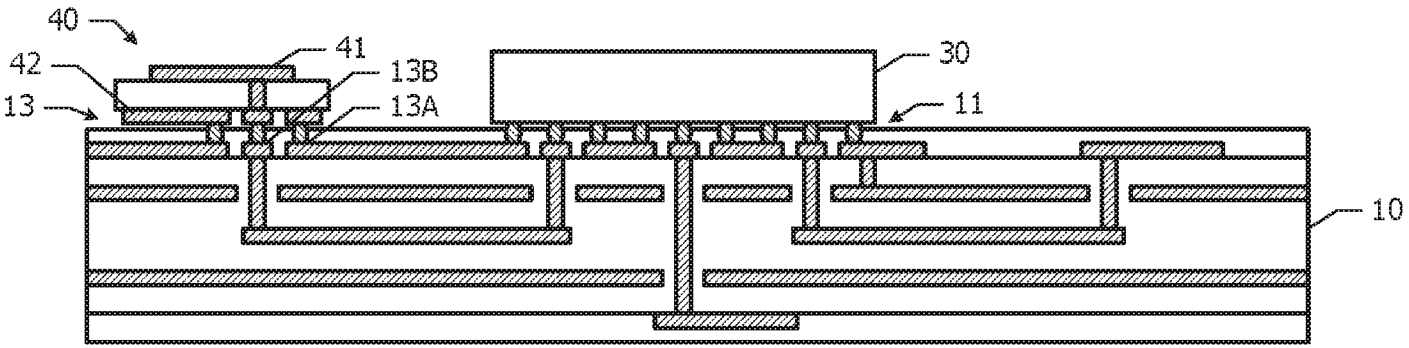
FIG. 3 is a cross-sectional view of the antenna module according to the first embodiment in a state of being used in a second utilization form.

FIG. 3 is a cross-sectional view of the antenna module according to the first embodiment in a state of being used in the second utilization form. The high-frequency integrated circuit element 30 is mounted on the circuit element mounting portion 11, an antenna element 40 (for example, a chip antenna) is mounted on the exposed terminal portion 13. The antenna element 40 includes a radiation element 41 and a ground conductor 42, the radiation element 41 and the ground conductor 42 configure a patch antenna. The radiation element 41 is connected to the high-frequency signal land 13B, and the ground conductor 42 is connected to the ground land 13A. The antenna element 40 radiates radio waves to the upper surface side of the dielectric substrate 10.

The antenna element 40 is post-installed on the antenna module according to the first embodiment. In contrast, the antenna element 12 (FIG. 1A) is built in the antenna module.

Next, a third utilization form of the antenna module according to the first embodiment will be described with reference to FIG. 4.

Figure 4:
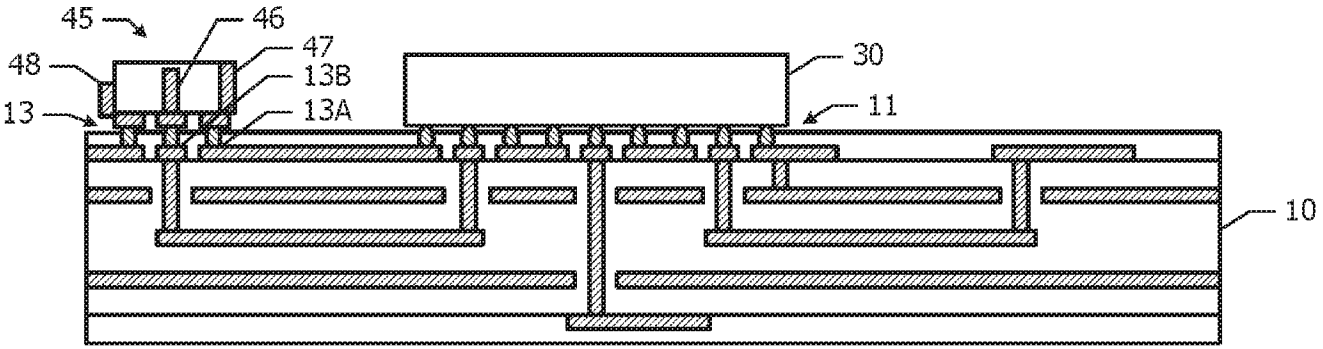
FIG. 4 is a cross-sectional view of the antenna module according to the first embodiment in a state of being used in a third utilization form.

FIG. 4 is a cross-sectional view of the antenna module according to the first embodiment in a state of being used in the third utilization form. The high-frequency integrated circuit element 30 is mounted on the circuit element mounting portion 11, an antenna element 45 (for example, a chip antenna) is mounted on the exposed terminal portion 13. The antenna element 45 includes a monopole antenna 46, a reflector 47, and a waveguide 48. The monopole antenna 46 is connected to the high-frequency signal land 13B. The reflector 47 and the waveguide 48 are connected to the ground lands 13A. The antenna element 45 radiates radio waves in a direction to which one end surface of the dielectric substrate 10 faces. The antenna element 45 is post-installed on the antenna module according to the first embodiment.

As described above, in the second and third utilization forms illustrated in FIG. 3 and FIG. 4, the exposed terminal portion 13 is used as a terminal for mounting an antenna element.

Next, excellent effects of the antenna module according to the first embodiment when used in the second and third utilization forms will be described.

When the lower surface of the dielectric substrate 10 (FIG. 1A) is brought into close contact with an inner side surface of a glass surface, a front surface made of dielectric material, or the like of a housing of a mobile terminal such as a smartphone or the like, a positional relationship between the radiation element 12B (FIG. 1A) provided on the lower surface of the dielectric substrate 10 and the surface of the housing is substantially constant regardless of a model of a mobile terminal. Therefore, directional characteristics or the like of the radiation element 12B are less affected by a difference of a structure for each model of a mobile terminal in which the antenna module is mounted. Accordingly, it is not necessary to design the radiation element 12B separately for each model of a terminal in which the radiation element is housed, it is sufficient to design to have common characteristics for a plurality of models.

On the other hand, directional characteristics of the antenna element installed at an end portion of the housing depend on a positional relationship between the antenna element and the end portion of the housing and a positional relationship between the antenna element and peripheral components. These positional relationships are not always the same for respective models of the mobile terminals. Accordingly, in order to obtain desired directional characteristics in various models, it is necessary to adjust characteristics of the antenna element positioned at the end portion of the housing for each model.

In the antenna module according to the first embodiment, it is possible to customize the post-installed antenna element 40 (FIG. 3) and antenna element 45 (FIG. 4) so as to obtain optimum characteristics (for example, polarization characteristics and directional characteristics) in accordance with a model of a terminal in which the antenna module is mounted. The characteristics of the radiation element 12B are less affected by a difference of a structure for each model of a mobile terminal, and thus the antenna module with the built-in radiation element 12B can be commonly applied to a plurality of models.

Second Embodiment

Next, an antenna module according to a second embodiment will be described with reference to FIG. 5 and FIG. 6. The following will describe differences from the antenna module according to the first embodiment illustrated in FIG. 1A to FIG. 4, and omit description of the common configuration.

Figure 5:
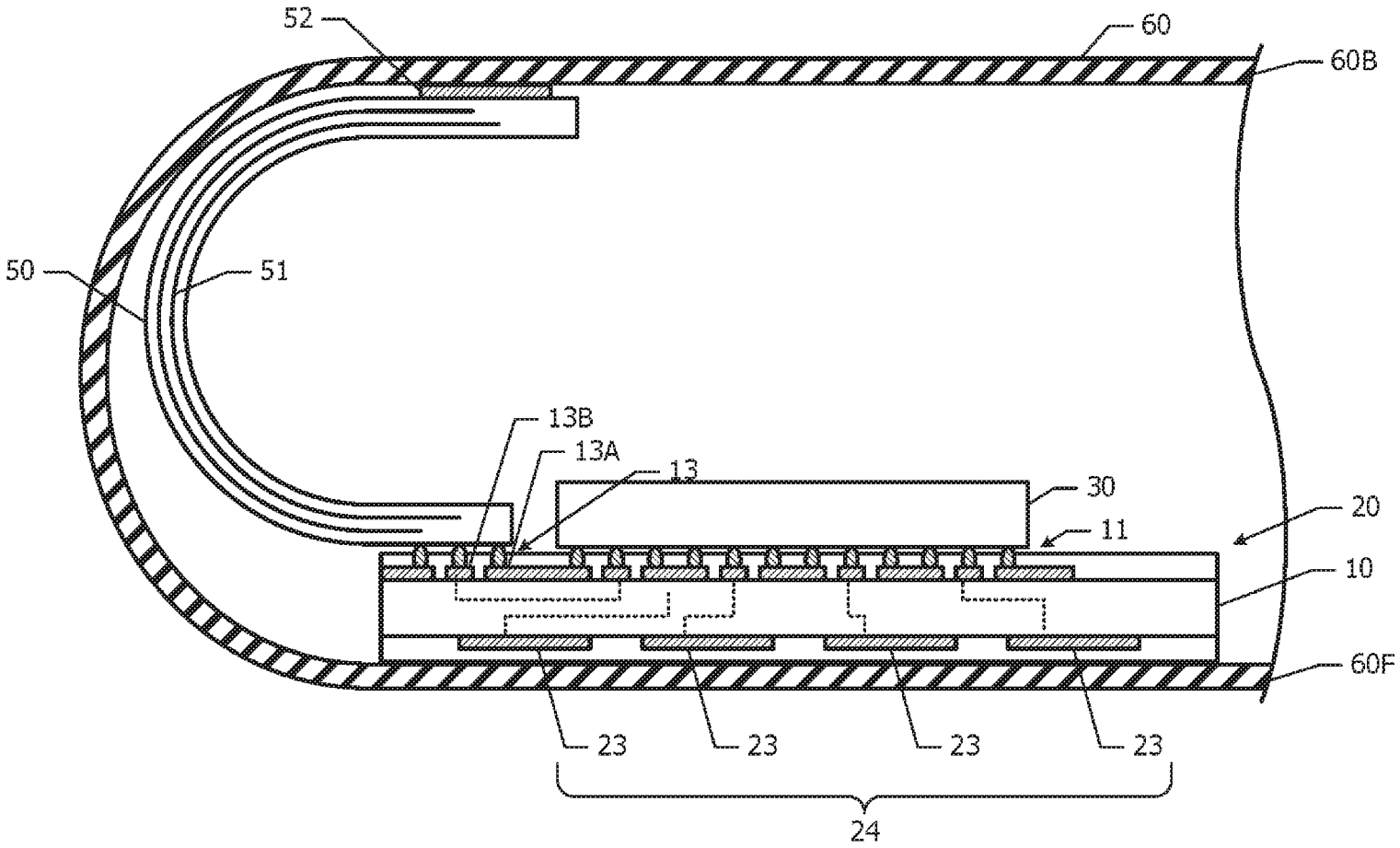
FIG. 5 is a partial cross-sectional view of a mobile terminal in which an antenna module according to a second embodiment is mounted.

FIG. 5 is a partial cross-sectional view of a mobile terminal in which an antenna module 20 according to the second embodiment is mounted. The antenna module 20 includes the dielectric substrate 10, the circuit element mounting portion 11, the exposed terminal portion 13, and an antenna element 24. The antenna element 24 includes a plurality of radiation elements 23 provided on the lower surface of the dielectric substrate 10. The plurality of radiation elements 23 configures a patch array antenna. The plurality of radiation elements 23 is respectively connected to high-frequency signal terminals of the high-frequency integrated circuit element 30 mounted on the circuit element mounting portion 11.

A flexible printed circuit substrate (FPC substrate) 50 is connected to the exposed terminal portion 13. The FPC substrate 50 is provided with a transmission line 51 and an antenna element 52. The antenna element 52 is connected to the ground land 13A and the high-frequency signal land 13B of the exposed terminal portion 13 through the transmission line 51. As the antenna element 52, for example, a patch antenna including a radiation element and a ground plane is used.

The antenna module 20 is housed in a substantially thin housing 60 such as a mobile terminal or the like. A surface of the dielectric substrate 10 on which the antenna element 24 is provided is close contact with an inner side surface of a front surface plate 60F of the housing 60. The antenna element 52 provided on the FPC substrate 50 is close contact with an inner side surface of a back surface plate 60B of the housing 60 by curving the FPC substrate 50.

The antenna element 24 built in the antenna module 20 radiates radio waves in a front surface direction of the housing 60, and the antenna element 52 provided on the FPC substrate 50 radiates radio waves in a back surface direction of the housing 60.

Figure 6:
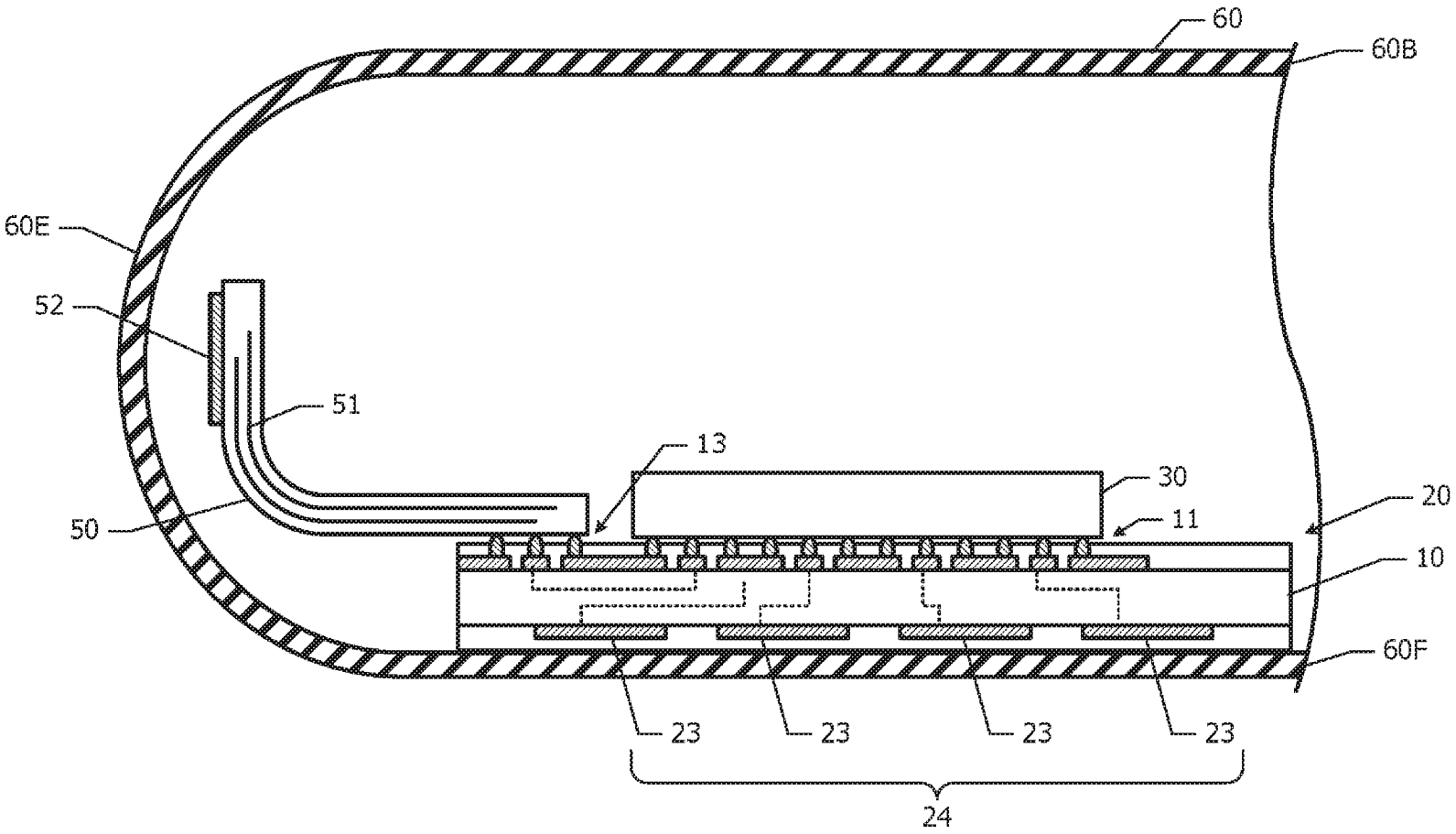
FIG. 6 is a partial cross-sectional view of another mobile terminal in which the antenna module according to the second embodiment is mounted.

FIG. 6 is a partial cross-sectional view of another mobile terminal in which the antenna module 20 according to the second embodiment is mounted. The antenna element 52 provided on the FPC substrate 50 is disposed inside an end plate 60E of the housing 60. The antenna element 52 radiates radio waves in a direction to which the end plate 60E of the housing 60 faces (a direction parallel to the front surface and the back surface).

Next, excellent effects of the antenna module according to the second embodiment will be described.

In the case where the dielectric substrate 10 is provided with both an antenna element for the front surface and an antenna element for the back surface, a positional relationship between the antenna element for the front surface and the antenna element for the back surface cannot be adjusted. It is difficult to secure a housing space of the antenna module at a position in the housing in which favorable antenna characteristics for both the antenna element for the front surface and the antenna element for the back surface can be obtained in some cases.

In contrast, in the antenna module according to the second embodiment, by deforming the FPC substrate 50, as illustrated in FIG. 5, a relative position between the antenna element 24 for the front surface and the antenna element 52 for the back surface can be adjusted. Accordingly, the antenna element 24 for the front surface and the antenna element 52 for the back surface can be respectively disposed at positions in which favorable antenna characteristics can be obtained. Even when the antenna module is housed in a mobile terminal of a different model, by changing a shape and a dimension of the FPC substrate 50, it is possible to optimize positions of a built-in antenna element 24 and a post-installed antenna element 52 for each model of a mobile terminal.

The radiation element 23 of the antenna element 24 is provided on a surface on the opposite side from a surface on which the circuit element mounting portion 11 and the exposed terminal portion 13 are provided. Accordingly, it is possible to dispose the radiation element 23 in close contact with or near the front surface plate 60F of the housing 60.

Furthermore, as illustrated in FIG. 6, it is also possible to dispose the antenna element 52 so as to radiate radio waves in a direction to which the end plate 60E of the housing 60 faces.

Next, various variations on the second embodiment will be described. As the post-installed antenna element 52 illustrated in FIG. 5 and FIG. 6, a patch array antenna may be used in the same manner as the built-in antenna element 24. In this case, the high-frequency signal lands 13B of the number corresponding to the number of the radiation elements of the patch array antenna may be disposed in the exposed terminal portion 13, and the FPC substrate 50 may be provided with a plurality of transmission lines.

Although the second embodiment indicates an example in which the FPC substrate 50 is provided with the antenna element 52, the FPC substrate 50 may be provided with a mounting portion for mounting an antenna element, and an antenna element having desired characteristics may be mounted on this mounting portion.

In the example illustrated in FIG. 5, the antenna element 24 provided on the dielectric substrate 10 is brought into close contact with the inner side surface of the front surface plate 60F of the housing 60 and the antenna element 52 provided on the FPC substrate 50 is brought into close contact with the inner side surface of the back surface plate 60B of the housing 60. However, as opposed to this, the antenna element 24 may be brought into close contact with the inner side surface of the back surface plate 60B and the antenna element 52 may be brought into close contact with the inner side surface of the front surface plate 60F. Additionally, it is not absolutely necessary for the antenna elements 24 and 52 to be brought into close contact with the inner side surface of the housing 60, gaps may be provided between the antenna elements 24 and 52 and the inner side surface of the housing 60.

In the example illustrated in FIG. 5 and FIG. 6, although a patch antenna is used as the antenna element 52 provided on the FPC substrate 50, antennas having other structures may be used. For example, a monopole antenna, a dipole antenna, a slot antenna, or the like may be used.

Third Embodiment

Next, an antenna module according to a third embodiment will be described with reference to FIG. 7 and FIG. 8. The following will describe differences from the antenna modules according to the first embodiment and the second embodiment, and omit description of the common configuration.

Figure 7:
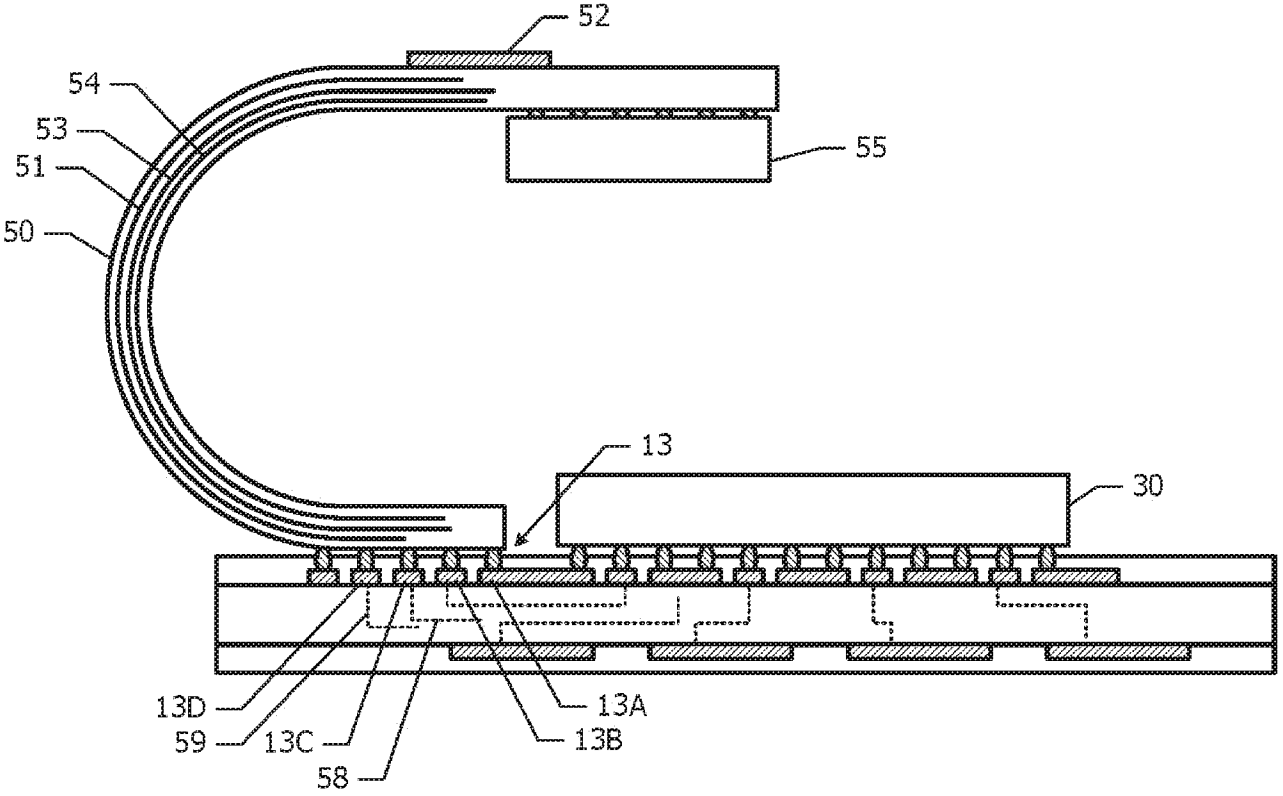
FIG. 7 is a cross-sectional view of an antenna module and a high-frequency component mounted on the antenna module according to a third embodiment.

FIG. 7 is a cross-sectional view of the antenna module and a high-frequency component mounted on the antenna module according to the third embodiment. In the first embodiment and the second embodiment, the ground land 13A and the high-frequency signal land 13B are disposed in the exposed terminal portion 13 (FIG. 1A and FIG. 5). In the third embodiment, an intermediate-frequency signal land 13C and a DC power supply land 13D are further disposed in the exposed terminal portion 13.

The intermediate-frequency signal land and the DC power supply land are also disposed in the circuit element mounting portion 11. The intermediate-frequency signal land and the DC power supply land of the circuit element mounting portion 11 do not appear in a cross section illustrated in FIG. 7. The intermediate-frequency signal land of the circuit element mounting portion 11 and the intermediate-frequency signal land 13C of the exposed terminal portion 13 are connected by a fourth transmission line 58 provided in the dielectric substrate 10. The DC power supply land of the circuit element mounting portion 11 and the DC power supply land 13D of the exposed terminal portion 13 are connected by a power supply wiring 59 provided in the dielectric substrate 10.

The FPC substrate 50 connected to the exposed terminal portion 13 is provided with an intermediate-frequency signal transmission line 53 and a DC power supply wiring 54 in addition to the high-frequency signal transmission line 51. On the FPC substrate 50, the antenna element 52 is provided and a baseband integrated circuit element 55 is mounted.

The baseband integrated circuit element 55 is connected to the intermediate-frequency signal land 13C and the DC power supply land 13D of the exposed terminal portion 13 through the transmission line 53 and the wiring 54 of the FPC substrate 50.

Next, an antenna module according to a variation on the third embodiment will be described with reference to FIG. 8.

Figure 8:
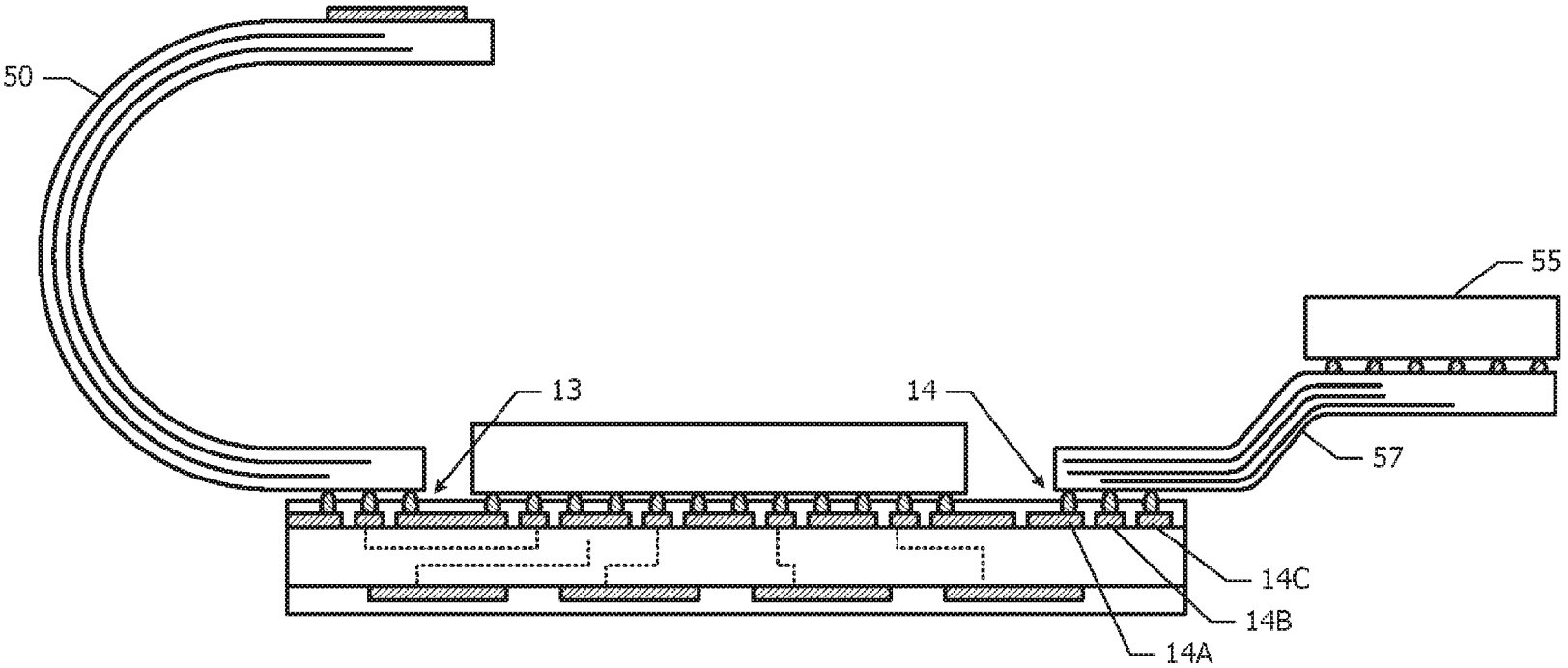
FIG. 8 is a cross-sectional view of an antenna module and a high-frequency component mounted on the antenna module according to a variation on the third embodiment.

FIG. 8 is a cross-sectional view of the antenna module and a high-frequency component mounted on the antenna module according to the variation on the third embodiment. In the third embodiment, the exposed terminal portion 13 is provided with the ground land 13A, the high-frequency signal land 13B, the intermediate-frequency signal land 13C, and the DC power supply land 13D (FIG. 7). In contrast, in the variation illustrated in FIG. 8, an exposed terminal portion 14 different from the exposed terminal portion 13 is provided with a ground land 14A, an intermediate-frequency signal land 14B, and a DC power supply land 14C. An FPC substrate 57 on which the baseband integrated circuit element 55 is mounted is connected to the exposed terminal portion 14.

Next, excellent effects of the antenna module according to the third embodiment and the variation thereon will be described. In the third embodiment, the high-frequency integrated circuit element 30 and the baseband integrated circuit element 55 are connected through the FPC substrate 50 connected to the exposed terminal portion 13. In the variation on the third embodiment, the high-frequency integrated circuit element 30 and the baseband integrated circuit element 55 are connected through the FPC substrate 57 connected to the exposed terminal portion 14. Accordingly, it is not necessary to provide a connector for connecting to the baseband integrated circuit element 55 on the dielectric substrate 10.

Fourth Embodiment

Next, an antenna module according to a fourth embodiment will be described with reference to FIG. 9. The following will describe differences from the antenna modules according to the first and second embodiments, and omit description of the common configuration.

Figure 9:
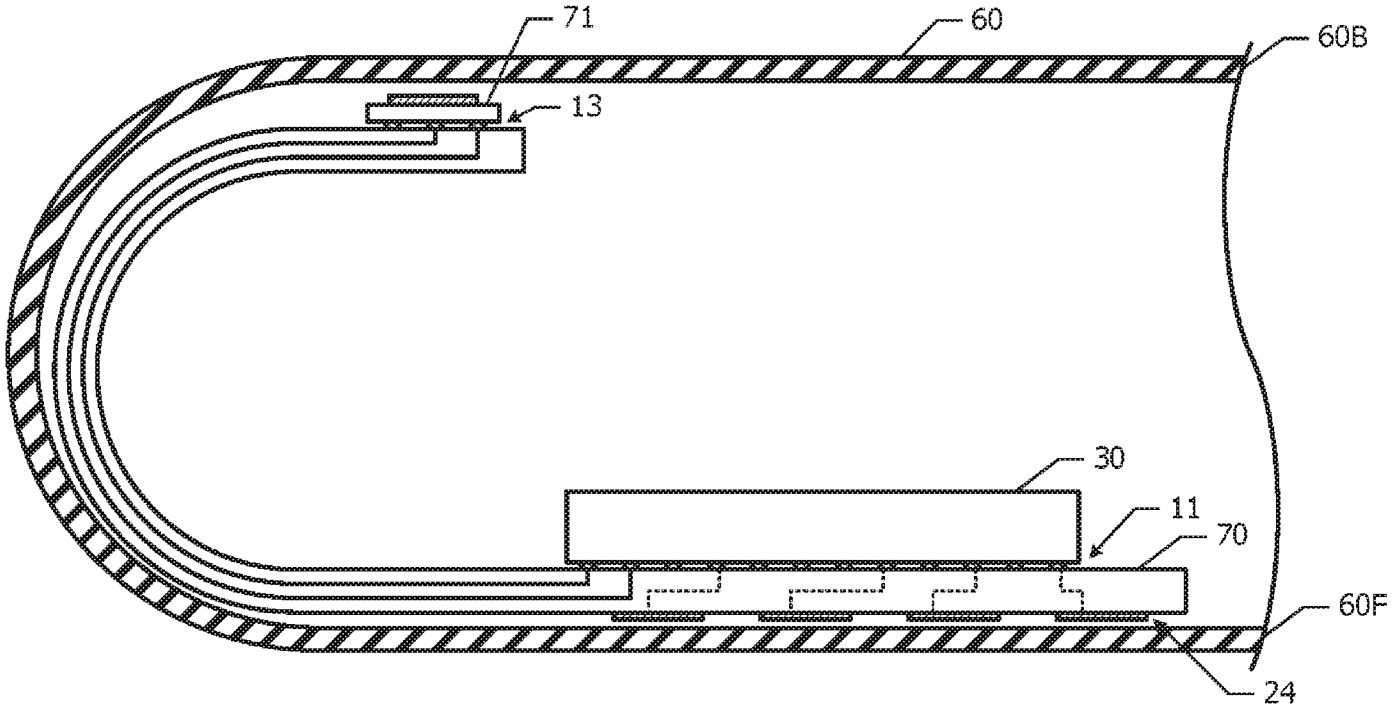
FIG. 9 is a cross-sectional view of an antenna module and a high-frequency component mounted on the antenna module according to a fourth embodiment.

FIG. 9 is a cross-sectional view of the antenna module and a high-frequency component mounted on the antenna module according to the fourth embodiment. In the first and second embodiments, the rigid dielectric substrate 10 is used for the antenna module. As opposed to this, in the fourth embodiment, an FPC substrate 70 is used for the antenna module.

The FPC substrate 70 is provided with the circuit element mounting portion 11, the exposed terminal portion 13, and the antenna element 24. The antenna element 24 is provided on a surface on the opposite side from a surface on which the circuit element mounting portion 11 is provided, and is disposed at a position at least partially overlapping with the circuit element mounting portion 11. The exposed terminal portion 13 is disposed at a position not overlapping with both the circuit element mounting portion 11 and the antenna element 24. The high-frequency integrated circuit element 30 is mounted on the circuit element mounting portion 11, and a post-installed antenna element 71 is mounted on the exposed terminal portion 13.

The antenna module is housed in the housing 60 such that a region, in which the antenna element 24 is disposed, of the FPC substrate 70 is close contact with the inner side surface of the front surface plate 60F of the housing 60, and the antenna element 71 is close contact with the inner side surface of the back surface plate 60B of the housing 60 by curving the FPC substrate 70.

Next, excellent effects of the antenna module according to the fourth embodiment will be described.

Because the exposed terminal portion 13 is disposed at the position not overlapping with both the circuit element mounting portion 11 and the antenna element 24, deforming the FPC substrate 70 makes it possible to change a positional relationship between the antenna element 71 mounted on the exposed terminal portion 13 and the built-in antenna element 24. Because the built-in antenna element 24 and the circuit element mounting portion 11 at least partially overlap with each other, the area of the FPC substrate 70 can be made smaller than that of the case where both of them are disposed so as not to overlap with each other.

As compared to the antenna module in the second utilization form (FIG. 3) according to the first embodiment, in the antenna module according to the fourth embodiment, the degree of freedom of the position of the post-installed antenna element 71 can be enhanced. As compared to the antenna module (FIG. 5) according to the second embodiment, in the fourth embodiment, it is sufficient to prepare the antenna element 71 having a chip antenna structure as a post-installed component to the antenna module, and it is not necessary to prepare the FPC substrate 50 for connecting to the dielectric substrate 10 illustrated in FIG. 5.

Fifth Embodiment

Next, an antenna module according to a fifth embodiment will be described with reference to FIG. 10. The following will describe differences from the antenna module according to the fourth embodiment, and omit description of the common configuration.

Figure 10:
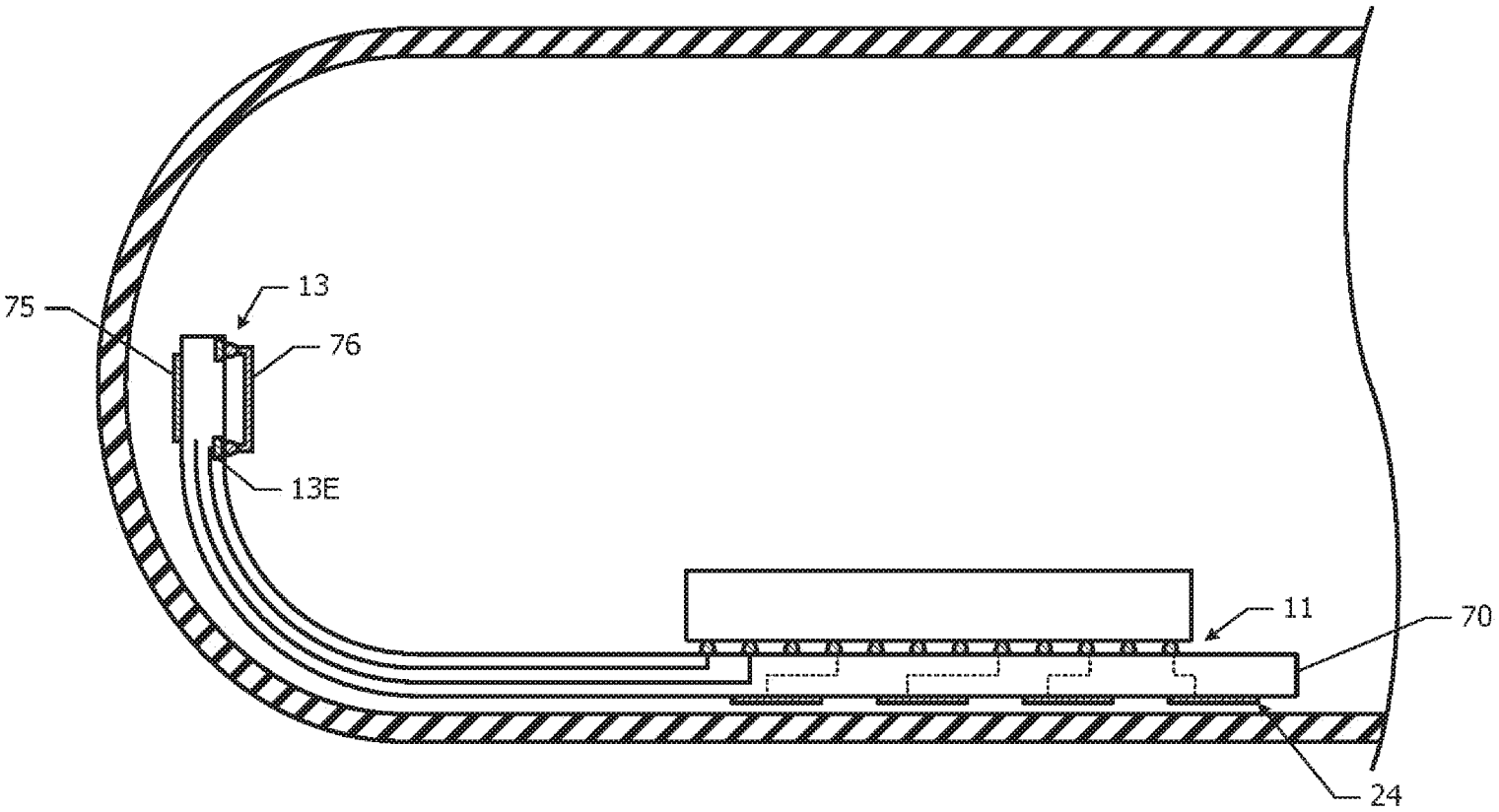
FIG. 10 is a cross-sectional view of an antenna module according to a fifth embodiment.

FIG. 10 is a cross-sectional view of the antenna module according to the fifth embodiment. In the fourth embodiment, the FPC substrate 70 is provided with the exposed terminal portion 13 (FIG. 9), and the antenna element 71 is post-installed on the exposed terminal portion 13. In contrast, in the fifth embodiment, although the FPC substrate 70 is used in the same manner as the fourth embodiment, both two antenna elements of the antenna element 24 and an antenna element 75 are built in the antenna module. The one antenna element 24 is disposed at a position partially overlapping with the circuit element mounting portion 11, the other antenna element 75 is disposed at a position not overlapping with both the circuit element mounting portion 11 and the antenna element 24.

The exposed terminal portion 13 is provided with a land 13E for connecting an antenna auxiliary component 76. Mounting the antenna auxiliary component 76 on the exposed terminal portion 13 makes it possible to adjust characteristics of the antenna element 75. As the antenna auxiliary component 76, for example, a reflector, a parasitic element, or the like can be cited. Mounting these types of the antenna auxiliary component 76 makes it possible to realize a wider band, directional characteristics control, characteristics deterioration suppression, or the like of the antenna element 75.

The embodiments described above are merely examples, and it goes without saying that partial replacements or combinations of configurations illustrated among different embodiments are also possible. The same actions and effects as in the same configurations in a plurality of embodiments are not stated for each embodiment. Furthermore, the present invention is not intended to be limited to the above-described embodiments. For example, it will be obvious to those skilled in the art that various changes, improvements, combinations, or the like can be made.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An antenna module comprising:

a dielectric substrate;

a circuit element mounting portion provided on the dielectric substrate, the circuit element mounting portion mounting a high-frequency integrated circuit element and including a ground land and a plurality of high-frequency signal lands;

a first antenna element including at least one radiation element provided on the dielectric substrate;

an exposed terminal portion provided on the dielectric substrate, the exposed terminal portion including an exposed ground land and an exposed high-frequency signal land;

a first transmission line provided with the dielectric substrate, the first transmission line connecting one high-frequency signal land of the circuit element mounting portion and the radiation element;

a second transmission line provided with the dielectric substrate, the second transmission line connecting another high-frequency signal land of the circuit element mounting portion and the high-frequency signal land of the exposed terminal portion;

a ground conductor connecting the ground land of the circuit element mounting portion and the ground land of the exposed terminal portion; and a second antenna element provided on the exposed terminal portion.

2. The antenna module according to claim 1, wherein the first antenna element includes the radiation element provided on a surface on an opposite side from a surface of the dielectric substrate on which the circuit element mounting portion is provided, and the exposed terminal portion is provided on a surface same as the surface of the dielectric substrate on which the circuit element mounting portion is provided.

3. The antenna module according to claim 1, wherein the dielectric substrate is configured of a flexible printed circuit substrate, the first antenna element is provided on the surface on an opposite side from the surface of the dielectric substrate on which the circuit element mounting portion is provided, and the first antenna element includes the radiation element disposed at a position at least partially overlapping with the circuit element mounting portion, and the exposed terminal portion is disposed at a position not overlapping with both the circuit element mounting portion and the radiation element.

4. The antenna module according to claim 1, further comprising a second exposed terminal portion that is different from the exposed terminal portion on which the second antenna element was provided, wherein a flexible printed circuit substrate was provided on the second exposed terminal portion.

5. The antenna module according to claim 4, wherein the circuit element mounting portion further includes an intermediate-frequency signal land and a DC power supply land, and the second exposed terminal portion further includes an exposed intermediate-frequency signal land and an exposed DC power supply land, the flexible printed circuit substrate further include an intermediate-frequency signal fifth transmission line and a DC power supply wiring, the antenna module further comprising:

an intermediate-frequency signal fourth transmission line provided with the dielectric substrate, the intermediate-frequency signal fourth transmission line connecting the intermediate-frequency signal land of the circuit element mounting portion and the intermediate-frequency signal land of the second exposed terminal portion;

the dielectric substrate, the power supply wiring connecting the DC power supply land of the circuit element mounting portion and the DC power supply land of the second exposed terminal portion; and a baseband integrated circuit element provided with the flexible printed circuit substrate, the baseband integrated circuit element connecting to the intermediate-frequency signal land of the second exposed terminal portion with the intermediate-frequency signal fifth transmission line provided therebetween, and connecting to the DC power supply land of the second exposed terminal portion with the DC power supply wiring provided therebetween.

6. A wireless communication device comprising:

a housing and the antenna module according to claim 5.

7. An antenna module comprising:

a dielectric substrate;

a circuit element mounting portion provided on the dielectric substrate, the circuit element mounting portion mounting a high-frequency integrated circuit element and including a ground land and a plurality of high-frequency signal lands;

a first antenna element including at least one radiation element provided on the dielectric substrate;

an exposed terminal portion provided on the dielectric substrate, the exposed terminal portion including an exposed ground land and an exposed high-frequency signal land;

a first transmission line provided with the dielectric substrate, the first transmission line connecting one high-frequency signal land of the circuit element mounting portion and the radiation element;

a second transmission line provided with the dielectric substrate, the second transmission line connecting another high-frequency signal land of the circuit element mounting portion and the high-frequency signal land of the exposed terminal portion;

a ground conductor connecting the ground land of the circuit element mounting portion and the ground land of the exposed terminal portion; and a flexible printed circuit substrate provided on the exposed terminal portion.

8. The antenna module according to claim 7, further comprising, provided with the flexible printed circuit substrate, a sixth transmission line and a third antenna element wherein the third antenna element was connected to the high-frequency signal land of the exposed terminal portion and the ground land of the exposed terminal portion with the sixth transmission line provided therebetween.

9. The antenna module according to claim 8, wherein the first antenna element includes the radiation element provided on a surface on an opposite side from a surface of the dielectric substrate on which the circuit element mounting portion is provided, and the exposed terminal portion is provided on a surface same as the surface of the dielectric substrate on which the circuit element mounting portion is provided.

10. The antenna module according to claim 9, wherein the third antenna element radiates radio waves in a opposite direction in which the radiation element radiates radio waves.

11. The antenna module according to claim 9, wherein the third antenna element radiates radio waves in a direction approximately 90 degree from a direction in which the radiation element radiates radio waves.

12. The antenna module according to claim 7, wherein the dielectric substrate is configured of a flexible printed circuit substrate, the first antenna element is provided on the surface on an opposite side from the surface of the dielectric substrate on which the circuit element mounting portion is provided, and the first antenna element includes the radiation element disposed at a position at least partially overlapping with the circuit element mounting portion, and the exposed terminal portion is disposed at a position not overlapping with both the circuit element mounting portion and the radiation element.

13. The antenna module according to claim 7, wherein the circuit element mounting portion further includes an intermediate-frequency signal land and a DC power supply land, and the exposed terminal portion further includes an exposed intermediate-frequency signal land and an exposed DC power supply land, the flexible printed circuit substrate further include an intermediate-frequency signal fifth transmission line and a DC power supply wiring, the antenna module further comprising:

an intermediate-frequency signal fourth transmission line provided with the dielectric substrate, the intermediate-frequency signal fourth transmission line connecting the intermediate-frequency signal land of the circuit element mounting portion and the intermediate-frequency signal land of the exposed terminal portion;

a power supply wiring provided with the dielectric substrate, the power supply wiring connecting the DC power supply land of the circuit element mounting portion and the DC power supply land of the exposed terminal portion; and a baseband integrated circuit element provided with the flexible printed circuit substrate, the baseband integrated circuit element connecting to the intermediate-frequency signal land of the exposed terminal portion with the intermediate-frequency signal fifth transmission line provided therebetween, and connecting to the DC power supply land of the exposed terminal portion with the DC power supply wiring provided therebetween.

14. A wireless communication device comprising:

a housing and the antenna module according to claim 13.

* * * * *